US007836617B2

(12) United States Patent
McCabe

(10) Patent No.: US 7,836,617 B2
(45) Date of Patent: Nov. 23, 2010

(54) LINEN SPREADER APPARATUS AND METHOD

(76) Inventor: Stanley G. McCabe, 1317 Harvard St., Lubbock, TX (US) 79403-2620

( * ) Notice: Subject to any disclaimer, the term of this patent is extended or adjusted under 35 U.S.C. 154(b) by 169 days.

(21) Appl. No.: 11/962,712

(22) Filed: Dec. 21, 2007

(65) Prior Publication Data

US 2008/0295367 A1 Dec. 4, 2008

Related U.S. Application Data

(63) Continuation-in-part of application No. 11/757,814, filed on Jun. 4, 2007.

(51) Int. Cl.
*D06F 67/04* (2006.01)
*D06F 67/00* (2006.01)

(52) U.S. Cl. ..... 38/143; 38/8

(58) Field of Classification Search ..... 38/143; 26/87; 414/13

See application file for complete search history.

(56) References Cited

U.S. PATENT DOCUMENTS 1,890,455 A * 12/1932 Consorti ..... 38/143
1,912,724 A 6/1933 Remington
1,997,267 A * 4/1935 Remington ..... 38/2
3,092,263 A 6/1963 Beaudry et al.
3,092,271 A 6/1963 Beaudry et al.
3,168,307 A 2/1965 Walton et al.
3,421,756 A 1/1969 Weir
3,429,063 A 2/1969 Myers
3,464,131 A * 9/1969 McCabe ..... 38/143
3,553,863 A 1/1971 Sjostrom
3,696,942 A 10/1972 Kitchener et al.
3,706,450 A * 12/1972 Gerstenberger et al. ..... 493/14
3,756,588 A * 9/1973 Gerstenberger ..... 38/143

(Continued)

FOREIGN PATENT DOCUMENTS

GB 2 219 313 12/1989

(Continued)

OTHER PUBLICATIONS

PCT Patentability Report dated Dec. 17, 2009 for PCT/US2008/064861.

(Continued)

*Primary Examiner*—Ismael Izaguirre
(74) *Attorney, Agent, or Firm*—Brinks, Hofer, Gilson & Lione

(57) ABSTRACT

A separated article of laundry is dragged over a plurality of wheels or belts. The wheels or belts adjust the amount of overhang on each side, making an edge of the article more horizontal. A clamp clamps the edge and drags the article of laundry from the wheels or belts. Resistance, such as by a pinch arm, may assist in untangling the article of laundry as the article is dragged. Sensors adjacent the belts or wheels measure a size of the article of laundry. A folder adjusts based on the size. For example, the types of folds to be made, the placement of runners for folding, or the output sorting are adjusted. The folder may operate more efficiently by providing time for the folder to adjust to the size of the article of laundry prior to feeding from the spreader.

27 Claims, 3 Drawing Sheets

U.S. PATENT DOCUMENTS

| | | | | |
|---|---|---|---|---|
| 3,874,043 | A | | 4/1975 | Holm |
| 3,911,604 | A | | 10/1975 | Sjostrom |
| 4,053,967 | A | | 10/1977 | Mair |
| 4,093,205 | A | * | 6/1978 | Kober ..... 493/425 |
| 4,106,227 | A | | 8/1978 | Allen et al. |
| 4,299,521 | A | | 11/1981 | Jensen |
| 4,327,510 | A | * | 5/1982 | Grantham ..... 38/8 |
| RE31,453 | E | | 12/1983 | Olsen et al. |
| 4,447,972 | A | | 5/1984 | McCabe |
| 4,774,505 | A | | 9/1988 | Ueda et al. |
| 4,943,198 | A | | 7/1990 | McCabe |
| 4,979,868 | A | | 12/1990 | Ueda et al. |
| 5,046,272 | A | | 9/1991 | Vogt et al. |
| 5,168,645 | A | | 12/1992 | Robin et al. |
| 5,169,282 | A | | 12/1992 | Ueda et al. |
| 5,172,502 | A | | 12/1992 | Kober |
| 5,179,795 | A | | 1/1993 | Nakamura et al. |
| 5,300,007 | A | | 4/1994 | Kober |
| 5,333,402 | A | | 8/1994 | Weir |
| 5,416,992 | A | | 5/1995 | Ueda et al. |
| 5,440,810 | A | | 8/1995 | Borucki et al. |
| 5,515,627 | A | | 5/1996 | McCabe |
| 5,546,684 | A | | 8/1996 | Jensen |
| 5,595,467 | A | | 1/1997 | Jensen |
| 5,611,159 | A | | 3/1997 | Jensen |
| 5,815,963 | A | * | 10/1998 | Rauch et al. ..... 38/143 |
| 6,141,893 | A | | 11/2000 | McCabe |
| 6,287,066 | B1 | | 9/2001 | Heinz et al. |
| 6,394,740 | B1 | | 5/2002 | Derby et al. |
| 6,477,797 | B1 | | 11/2002 | Takahashi et al. |
| 6,533,267 | B1 | | 3/2003 | Muessig et al. |
| 6,584,711 | B1 | | 7/2003 | Nakamura |
| 6,655,890 | B1 | | 12/2003 | Weir |
| 6,826,856 | B1 | | 12/2004 | McCabe |
| 6,883,258 | B2 | | 4/2005 | McCabe |
| 7,127,840 | B2 | | 10/2006 | McCabe |
| 7,555,857 | B2 | * | 7/2009 | McCabe ..... 38/143 |
| 2005/0028410 | A1 | | 2/2005 | McCabe |
| 2006/0191171 | A1 | | 8/2006 | Jensen et al. |

FOREIGN PATENT DOCUMENTS

| | | | |
|---|---|---|---|
| JP | 08-151025 | | 6/1996 |
| JP | 2002-211523 | | 7/2002 |
| JP | 2004-065314 | A | 3/2004 |
| JP | 2005-163241 | A | 6/2005 |

OTHER PUBLICATIONS

USPTO Office Action dated Apr. 9, 2010 for parent U.S. Appl. No. 11/757,814.

* cited by examiner

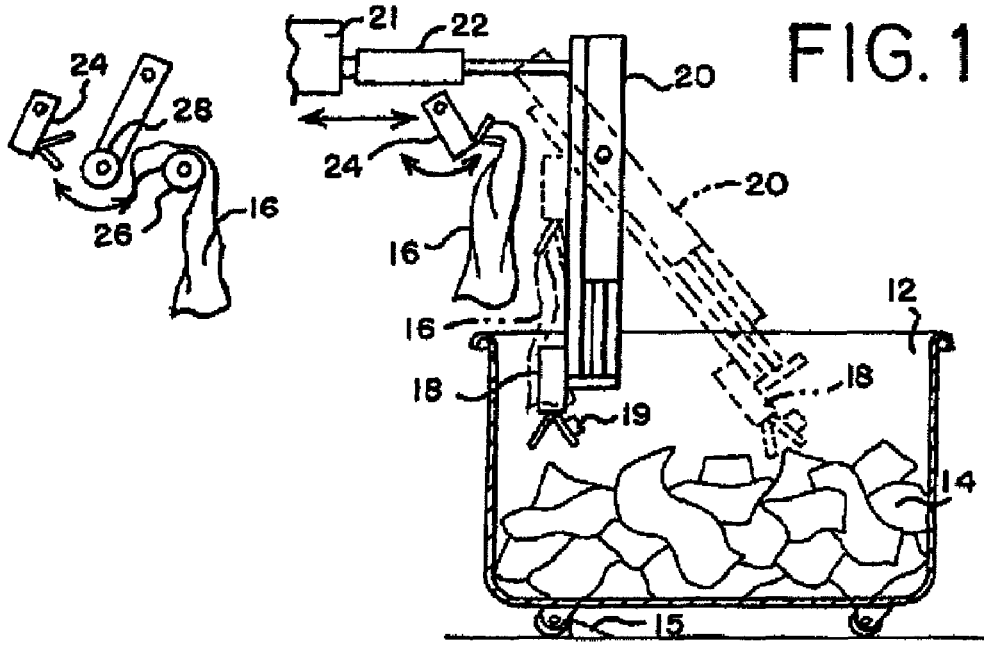
FIG. 1
FIG. 2
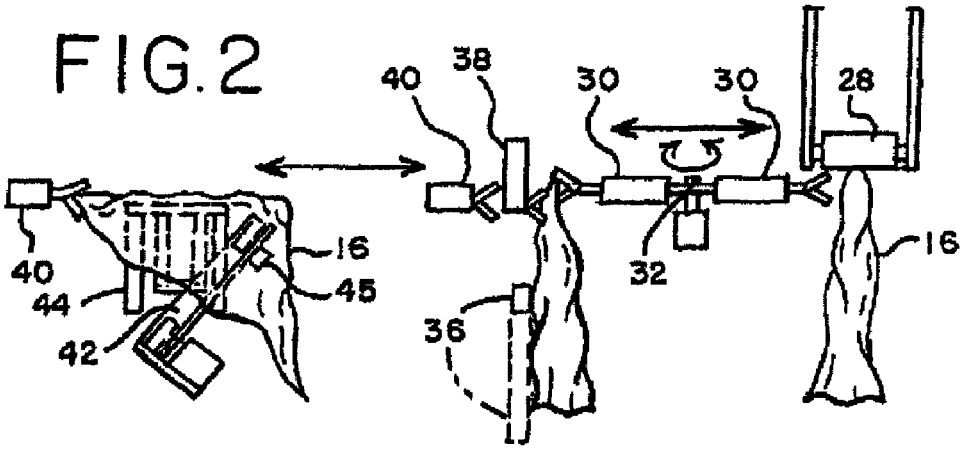
FIG. 3
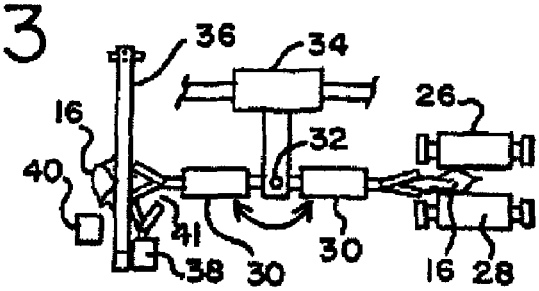

LINEN SPREADER APPARATUS AND METHOD

RELATED APPLICATIONS

The present patent document is a continuation-in-part of application Ser. No. 11/757,814, filed Jun. 4, 2007, the disclosure of which is hereby incorporated by reference.

BACKGROUND

The present invention relates to automated laundry spreaders. In particular, a spreader for laying articles of laundry, such as towels or sheets, out flat is provided.

Many processes in laundries are automated. For example, machines in hotels spread out, iron and fold sheets without operator intervention. To begin the automated process, the operator identifies either corners or an edge of the sheet and places the corners or edge into the first machine. Since sheets have large dimensions with thin fabric, the sheets are often tangled together, necessitating either an automated separator machine or an operator for locating the edges or corners.

Since towels are smaller and thicker, towels may be less likely tangled after removal from a washing or drying machine. However, in typical towel processing, an operator still grabs individual towels and places them on folding machines. Where possible, automated processes may save money over time.

Machines for automatically grabbing articles of laundry from a load of articles and spreading the articles have been attempted, but find little commercial success. Typically, these machines attempt to isolate diagonal corners and then opposite corners. Such isolation can be difficult and inconsistent when implemented with a machine.

BRIEF SUMMARY

By way of introduction, the preferred embodiments described below include apparatuses and methods for spreading an article of laundry from a load of articles of laundry. A separated article of laundry is dragged over a plurality of wheels or belts. The wheels or belts adjust the amount of overhang on each side, making an edge of the article more horizontal. For example, the edge on one side is positioned adjacent a top of the wheels or belts. A clamp clamps the edge between the wheels or belts and drags or pulls the article of laundry from the wheels or belts. A pinch arm assists in holding the article of laundry on the wheels or belts or may be used for resistance.

Sensors adjacent the belts or wheels or adjacent other portions of the spreader measure a size of the article of laundry. For example, a width of a towel is measured to determine whether the towel is a bath towel or a hand towel. The size information is fed forward to a folder. The folder adjusts based on the size. For example, the types of folds to be made, the placement of runners for folding, or the output sorting are adjusted. The folder may operate more efficiently by providing time for the folder to adjust to the size of the article of laundry.

Different features or components described above may be used separately or in combination.

In a first aspect, an apparatus is provided for spreading an article of laundry. First and second rotatable supports connect with the frame. The first and second rotatable support have horizontally spaced apart first and second upper surfaces, respectively. At least one drive is operable to rotate the first and/or second rotatable supports. The rotation moves an edge of an article of laundry resting on the first and second rotatable supports adjacent both the first and second upper surfaces.

In a second aspect, a method is provided for spreading an article of laundry. A first part of the article of laundry is dragged over first and second rotatable supports. The first rotatable support is spaced from the second rotatable support. A hanging of the article of laundry is adjusted with the first and second rotatable supports such that an edge of the article of laundry hangs generally horizontally between the first and second rotatable supports. The edge of the article of laundry is clamped.

In a third aspect, an apparatus is provided for spreading an article of laundry. A spreader is operable to separate the article of laundry from a bundle of articles and spread the article of laundry out flat. A sensor on the spreader is operable to determine a size of the article of laundry. A folder is operable to receive the article of laundry laid out flat from the spreader. The folder is responsive to the size from the sensor.

In a fourth aspect, a method is provided for spreading an article of laundry. The article of laundry is separated from a bundle of articles. A sensor determines a size of the article. A spreader spreads the article of laundry out flat. The article of laundry is fed to a folder. The folder adjusts as a function of the size.

The present invention is defined by the following claims, and nothing in this section should be taken as a limitation on those claims. Further aspects and advantages of the invention are disclosed below in conjunction with the preferred embodiments.

BRIEF DESCRIPTION OF SEVERAL VIEWS OF THE DRAWINGS

The components and the figures are not necessarily to scale, emphasis instead being placed upon illustrating the principles of the invention. Moreover, in the figures, like reference numerals designate corresponding parts throughout the different views.

FIG. 1 is a front view of initial stages of a linen spreader in one embodiment;

FIG. 2 is a side view of middle stages of the linen spreader in one embodiment;

FIG. 3 is a top view of part of the middle stages of FIG. 2;

DETAILED DESCRIPTION OF THE PREFERRED EMBODIMENTS

Figure 7:
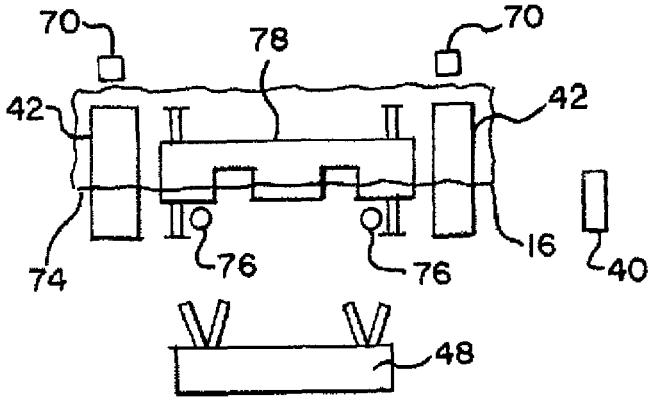
FIGS. 7-9 are top, front, and side views of another embodiment of the middle stages of FIG. 2.
Figure 9:
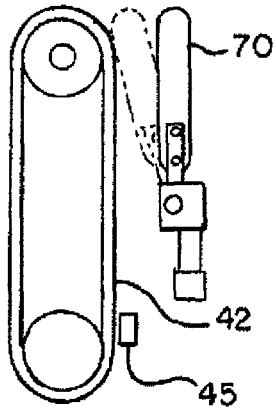
Figure 8:
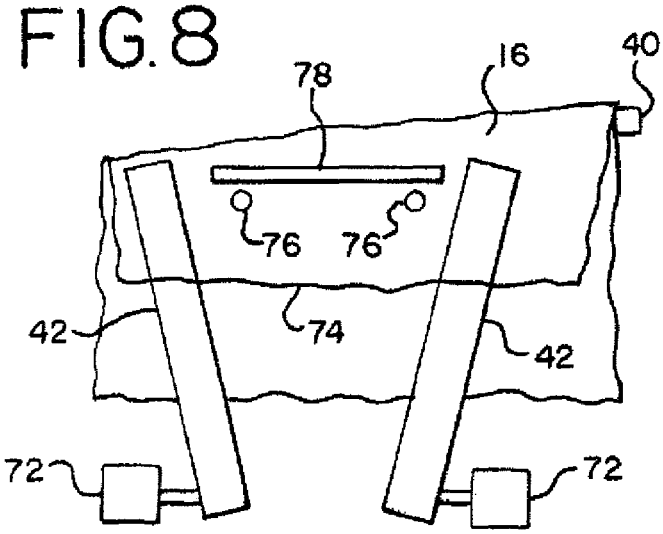

FIGS. 1-6 show various aspects of one embodiment. FIGS. 1-6 show an apparatus and represent the method for spreading an article of laundry. Various stages and aspects of the embodiment may be altered or changed based on now known or later developed devices and methods. For example, FIGS. 7-9 show an alternative embodiment of the middle stage. Different stages or components may be used independently of other stages or components in alternative embodiments. Additional, different, or fewer components than described below may be used.

Figure 10:
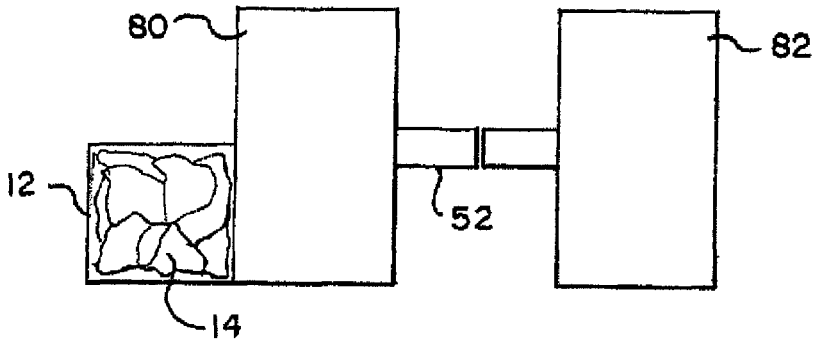
FIG. 10 is a side view of one embodiment of a spreader and folder operable together.

The spreader isolates a towel, sheet or other article of laundry from a load of articles of laundry and spreads the article out flat for subsequent processing. For example, a towel is output to an automated towel folder, such as disclosed in U.S. Pat. No. 5,300,007, the disclosure of which is incorporated herein by reference. FIG. 10 shows one embodiment of the spreader and the folder operable together. Alternatively, the spread article is output to an operator or stacked for further use.

The linen spreader described herein is adapted for isolating and spreading rectangular or square towels, sheets, or other linens of various sizes, including bath towels, beach towels, and hand towels. For example, terry cloth bath towels of any size are processed. Larger towels or smaller towels may also be processed, such as square washcloths or cotton shop towels. Articles with thinner material, such as woven or knit pillowcases, pillow shams, or other laundry articles may also be processed. Other articles of laundry, such as sheets or blankets, may also be spread, in part or total, using one, more or all of the stages described herein.

FIGS. 1-6 show one apparatus positioned within a single frame structure. One example portion of the frame structure is represented at 21 for connecting with a drive 22. The frame structure includes beams, plates, mounts, legs, covers, and/or other components. The clamps, drives, or other components described herein connect directly or indirectly with the frame. Bolts, welding, clamps, screws, pins, and/or other connectors may be used.

Different portions of the apparatus are shown in different views to illustrate the components and operation of various stages for spreading a linen. In one embodiment, the stages are built together within the framework in as small a space as possible while providing sufficient volume for spreading. Various plates for safety and preventing operators from entanglement within the spreader are included, but not shown. Electrical, hydraulic, and/or air pressure cables and hoses interconnect various components for controlling and operating spreading. These cables and hoses are configured and routed as is known in the art or later developed. One or more controllers, such as a processor, coordinate the movement and operation of the various components. These components are not shown to avoid complicating the Figures. Instead, the components operating on the article of laundry are shown and described.

The components include clamps and drives. Different clamps may have the same or different structures, such as a chuck, scissor clamp, two opposing plates, jaws, pinch roller, pinch plates, pinching belts, or other structure operable to hold a article of laundry. In one embodiment, the clamp includes two metal plates separated by a space for one jaw and an opposing metal jaw operable to move between the two plates of the other jaw. The article is clamped between the two jaws. In another embodiment, the clamp includes two prongs or plates operable to press together or one prong operable to press against another. In yet other embodiments, a cylinder or actuator extends against a plate or surface for clamping. One or more of the jaws may be toothed or coated in rough or gripping material.

The different clamps discussed below may be of one of the embodiments above or a different embodiment, such as a now known or later developed embodiment. One embodiment may be used below to describe a particular clamp, but other embodiments may be used.

The clamping motion, rotation, linear movement, or other movement of the clamps, rollers, runs, or other components are performed by drives. The drives include one or more pneumatic cylinder or cylinders, electric servos, air driven cylinders, hydraulic cylinders, pneumatic actuators, extending screw devices with an electric motor or other mechanism, combinations thereof, or other now known or later developed force applying device. The drives connect with the component being forced. For example, one or more jaws of a clamp are actuated by a pneumatic cylinder through a push/pull rod. Other drive structures may be provided, such as a pulley and motor with an endless belt or chain. For example, a timing belt with an inverter is used. As another example, a guide or run is provided for movement of a clamp between two locations. The drive includes an actuator long enough to extend to and retract from the two locations. Other now known or later developed drives and associated structures may be used.

The different drives and structures discussed below may be one of the embodiments above or a different embodiment, such as a now known or later developed embodiment. One embodiment may be used below to describe a particular drive or structure, but other embodiments may be used. Similarly, rotation or linear motion may be described below, but other motions may be provided.

The clamping and driving are controlled by a controller. The controller is a processor, computer, or other device for receiving inputs and generating outputs. In response to sensors, such as contact, infrared, light beam and detector, or other sensors, the controller causes the clamps to clamp, the drives to move, or other action. Any now known or later developed controller and sensors may be used. One embodiment may be used below to describe a particular controller and/or sensor, but other embodiments may be used.

Metal, plastic, wood, fabric, and/or other materials may be used for any component. The various components use materials now known or later developed, such as aluminum, steel, or other metal.

FIG. 1 shows a bin 12 for holding a load of articles 14. The bin 12 is a pick-up area for holding a group of articles of laundry. The bin 12 is of various sizes or shapes. For example, the bin 12 is a wheeled laundry truck. The bin 12 has sides to contain the laundry, but may be a flat surface without walls, such as a conveyor or floor. In one embodiment, the bin 12 tapers towards one location at the bottom of the bin 12. As articles are removed from the bin 12, remaining articles migrate towards the location for clamping. In alternative embodiments, conveyors, vibration, tilting mechanisms, troughs, or other devices are provided for continually positioning articles near a clamping position. In other embodiments, no extra guidance is provided for the articles 14 in the bin 12.

The bin 12 is fixed to the frame. Alternatively, the bin 12 is releasable from the frame, such as disclosed in U.S. Pat. No. 6,655,890, the disclosure of which is incorporated by reference. In another embodiment for use with a wheeled cart, a tapered plate 15, rail, or other structure is provided to hold the bin 12 in place relative to the frame during operation. The bin 12 is wheeled over the plate 15. The frame and plate 15 prevent the bin 12 from moving away from a clamp 18.

For grabbing articles of laundry 16 from the bin 12, the clamp 18 operates on a clamp run 20. The clamp 18 is movable along the clamp run 20. In one embodiment, the clamp 18 has two jaws coated or textured for gripping articles of laundry. The jaws are narrow plates that press together at the ends or along a portion of the plates. The clamp 18 is actuated by a pneumatic cylinder or other drive. One or both jaws of the clamp 18 connect with the pneumatic cylinder or a plurality of cylinders. The article 16 is clamped between the two jaws. For example, the clamp 18 is positioned on top of or in the load 14. The article 16 of laundry is clamped while in the load 14.

The clamp run 20 is a drive, guide, timing belt, toothed gear, chain, drive shaft, or other structure for moving the clamp 18 towards and away from the bin 12. In one embodiment, the clamp run 20 is a pulley and motor with an endless belt or chain. For example, a timing belt with an inverter is used. The clamp 18 connects to the endless chain to clamp in a downward direction. The clamp run 20 may include a telescoping portion for further range of motion of the clamp 18, such as the belt and pulley being on one portion operable to move relative to another portion.

The clamp run 20 mounts to the frame at a pivot point at any location. The clamp run 20 is moveable. In the embodiment shown, the clamp run 20 is generally vertical in one position, but may be rotated away from vertical as represented by the dashed lines. Alternatively, the clamp run 20 is fixed relative to the frame.

The clamp 18 is moved downward to a bottom of the clamp run 20. A sensor, gravity, or interference by the load 14 may be used to determine where to stop the clamp 18 relative to the load 14. The clamp 18 clamps one or more articles 16. The clamp 18 is sized to most likely select a single article, such as by having jaws that extend only about one or a few inches. The clamped article 16 and clamp 18 are moved away from the load 14, such as upwards. FIG. 1 shows the same clamp 18 at two different example locations. The clamp run 20 includes only a single clamp 18, but may include multiple clamps.

The load 14 may be unevenly distributed or may not shift as articles or laundry are removed from a same location by the clamp 18. By reorienting the clamp run 20, the clamp 18 may be positioned into different horizontally spaced locations relative to the load 14. Two or more different locations may be used.

The drive 22 connects with the frame 21. The drive 22 includes a rod for extending and withdrawing. By operating the drive 22, the clamp 18 and clamp run 20 are oriented at different locations or portions of the pick-up area. In the example shown, the clamp run 20 is vertical for clamping articles at a front of the bin 12 and at an angle from vertical for clamping articles at a back of the bin 12. The angle results in the clamp run 20 being more horizontal than the vertical orientation. In alternative embodiments, the clamp run 20 and/or drive 22 operate to position the clamp 18 at different locations within the bin in other ways. For example, the clamp run 20 is always vertical, but the drive 22 moves the clamp run 20 relative to the bin 12 along a guide. As another example, the clamp run 20 is fixed relative to the frame, and the article of laundry 16 are moved under the clamp run 20.

The clamp 18 repetitively clamps articles of laundry 16 from a same location. A sensor 19 detects whether an article is clamped during each attempt. Any sensors may be used, such as weight or light beam sensors. If an article is not clamped, the controller actuates the drive 22 to reorient the clamp 18. In a next attempt, the clamp 18 will contact the load 14 at a different location. In alternative embodiments, the orientation of the clamp run 20 is changed for additional or alternative reasons than failure to clamp, such as changed periodically regardless of failure to clamp. The orientation may be changed due to failure to clamp or a number of attempts at one orientation.

The clamped articles of laundry 16 are positioned along the clamp run 20 near the top for clamping by the clamp 24. In one embodiment, the clamp 24 is a pass-by scissors clamp with one serrated jaw passing between two serrated plates of the other jaw and a sensor for detecting clamping. The clamp 24 clamps near the pivot point so that clamping occurs at a same location regardless of the orientation of the clamp run 20. Alternatively, the clamp 24 rotates about a pivot point to align with the orientation of the clamp run 20. In another alternative, the clamp run 20 rotates to vertical for clamping by the clamp 24. Combinations of these embodiments may be used.

In response to timing on a timing chain of the clamp run 20 and/or electric eyes indicating that the article 16 is positioned on the upper location, the clamp 24 is activated to move and/or rotate to the article of laundry. For example, the clamp 24 moves laterally and rotates to clamp. The clamp 24 clamps the article 16 of laundry just below the clamp 18. In one embodiment, a sensor is provided to detect contact of the clamp 24 with the article 16. In other embodiments, the clamp 24 is positioned to where a article 16 should be positioned. In response to the closing of clamp 24, the clamp 18 releases the article 16. The clamp 24 grabs the article 16 just below the clamp 18 or at another location anywhere on the article 16.

The clamp 24 moves laterally to transfer the article 16 of laundry. The clamp 24 is shown in two different example positions in FIG. 1. The two positions correspond generally to the extent of the lateral movement. One or more clamps 24 may be used. The clamp 24 moves the article of laundry from the clamp 18 to a pair of rollers 26, 28. Plates, guides, and/or brushes may be used to contact the article 16 of laundry during transfer to the rollers 26, 28. For example, a plate is provided at an angle (e.g., 45 degrees) to guide the article to the rollers 26, 28, reduce drag from the article 16 of laundry during operation of the rollers 26, 28, or guide discarded articles 16 back into the bin 12. Brushes along the sides may assist in aligning the article of laundry to fall between the rollers 26, 28 at a centered location.

The rollers 26, 28 are clutch rollers, but other rollers may be used. Solid rollers, belts, conveyors, or other structures may be used for the rollers 26, 28. In one embodiment, the roller 28 is moveable to and away from the other roller 26. Brackets supporting the roller 28 rotate to move the roller 28. A drive positions the roller 28 spaced away from the roller 26 for receiving the article 16 of laundry. The clamp 24 releases the article 16 of laundry over the gap between the rollers 26, 28. Such a gap is shown in FIG. 1.

Upon release by the clamp 24, the roller 28 is rotated against or to contact the article 16 of laundry adjacent the roller 26. A nip is formed between the rollers 26, 28. In alternative embodiments, the roller 26 moves or both rollers 26, 28 move relative to each other.

The roller 28 is not a driven roller, but the roller 26 is driven. Both rollers 26, 28 or the roller 28 may be driven. The roller 26 drives the article of laundry between the rollers 26, 28. For example, the article 16 of laundry is driven downwards as shown in FIG. 2. The roller 26 continues rotating until a corner or last portion of the article 16 of laundry is between the rollers 26, 28. A sensor detects the trailing portion of the article 16 of laundry just above the nip formed by the rollers 26, 28. Once the trailing portion is between the rollers 26, 28, one or both of the rollers 26, 28 are braked to hold the article 16, such as suspended in FIG. 2.

FIGS. 2 and 3 show further processing of the article 16 of laundry. The article 16 of laundry is transferred from the rollers 26, 28 to a rotatable clamp 30. FIG. 2 shows the rotatable clamp 30 in two positions from a side view, and FIG. 3 shows the rotatable clamp 30 in two positions from a top view. Only one rotatable clamp 30 is used, but multiple rotatable clamps 30 may be provided. In one embodiment, the rotatable clamp 30 is a pass-by scissors clamp with one serrated jaw passing between two serrated plates of the other jaw.

The clamp 30 rotates in a horizontal plane, but may rotate vertically or out of the horizontal plane.

In one embodiment, the rotatable clamp 30 includes a drive for rotating about a pivot location 32 and a separate drive 34 for lateral movement. The clamp 30 may be on an arm or otherwise extend from the pivot location 32 to provide the desired range of motion and centrifugal force. The rotatable clamp 30 moves laterally while rotated to clamp the article 16 of laundry suspended from the rollers 26, 28. The article 16 of laundry is clamped adjacent to or just below the corner held by the rollers 26, 28, but other locations may be clamped. In one embodiment, a sensor is provided to detect contact of the clamp 30 with the article. In other embodiments, the clamp 30 is positioned to where an article should be positioned. In response to the closing of clamp 30, the rollers 26, 28 release the article.

Upon release, the clamp 30 and arm rotates. Any amount of rotation may be used, such as 180 degrees. The clamped article 16 of laundry is rotated with the clamp 30. The rotation has sufficient force to cause part of the article of laundry to extend away from the clamped corner by centrifugal force. For example, the article 16 of laundry rotates sufficiently quickly that a corner extends outward relative to the clamped corner. The short edge is common to the clamped corner and the corner extending outward due to the rotation. Greater or less centrifugal force may be applied. Lateral movement of the clamp 30 during, before, or after rotation may or may not also be provided. Plates, rubber stoppers, other stoppers, pneumatic cylinders or other devices may be used for limiting the rotation. Alternatively, the operation of the drive is used to limit the rotation. In alternative embodiments, rotation is not provided or is slow enough to have little effect on spreading the article 16 of laundry.

The clamp 30 rotates and/or moves such that the article 16 of laundry contacts a stop 36. The stop 36 is a bar, plate, or other structure at least partially interfering with movement of the article 16 of laundry. The stop 36 is smooth or textured, such as for limiting sliding of the article 16. The stop 36 is positioned to contact the article 16 of laundry during the rotation in one embodiment. The stop 36 is sufficiently long to catch at least part or all of a width of the article 16 of laundry. By contacting just a portion of the width, the article of laundry may more likely spread out or be maintained spread out. The article 16 of laundry may extend from the clamp 30 to the end of the stop 36 with only one or no folds, such as a short edge or fold by the short edge extending from the stop 36 to the clamp 30. The stop 36 is positioned at any level or height relative to the clamp 30. In one embodiment, the top of the stop 36 is about ¼-½ the length of the article 16 below the clamp 30.

In one embodiment, the stop 36 is fixed. For example, the clamp 40 drags the article 16 of laundry over the stop 36. In other embodiments, the stop 36 rotates, slides, or otherwise moves. For example, the stop 36 blocks the article 16 of laundry during rotation or at the end of rotation, but moves to limit or avoid interfering with the article 16 of laundry while being moved by the clamp 40. FIGS. 2 and 3 show the stop 36 able to rotate downwards to avoid interference and rotate upwards to horizontal to block. In one embodiment, the stop 36 rotates downward as or after the clamp 38 grabs the article 16 of laundry.

Figure 4:
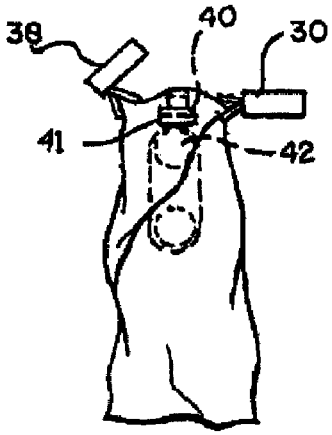
FIG. 4 is a front view of one of the middle stages of FIGS. 2 and 3.

As shown in FIGS. 2-4, a clamp 38 clamps the article 16 of laundry while the clamp 30 clamps but after rotation. The clamp 38 rotates downward and to the side to clamp a portion of the article 16 of laundry spaced away from the corner clamped by the rotatable clamp 30. Due to the rotation, the clamp 38 likely clamps an edge or single fold of the article 16, but spaced away from the corner portion clamped by the rotatable clamp 30. For example, the clamp 38 clamps two-to-ten inches lower than the rotatable clamp 30.

After clamping, the clamp 38 rotates away and upwards to spread the article 16 of laundry. FIG. 4 shows the article 16 of laundry with a portion spread apart between the clamp 38 and the rotatable clamp 30. After or during spreading, the stop 36 may move away from the path of travel of the article 16 of laundry.

In an alternative embodiment for spreading sheets, an additional clamp, similar to clamp 38 but opposite clamp 38 relative to clamp 30, operates in sequence with the clamp 38. While held by the clamp 30 and clamp 38, air is used to clean any wrinkles. The opposite clamp grabs the sheet and the clamp 38 releases the sheet. Clamp 30 continues to hold the sheet. The clamp 38 then grabs the sheet again for clamping by the clamp 40. Other combinations of release and grabbing sequences may be used.

After spreading, the clamp 40 moves to clamp the article 16 of laundry. The clamp 40 has two plates for jaws to clamp an elongated region of the article 16 of laundry between the clamp 38 and the rotatable clamp 30. The elongated region is wider than the portions clamped by the clamp 38 or rotatable clamp 30, but may be the same or less. Multiple clamps or clamping a non-elongated region may be used.

The clamp 40 clamps between the clamp 38 and rotatable clamp 30 while held by both. The region may be on a similar level as the clamp 38, the rotatable clamp 30, and/or both, or a different level, such as a few inches below.

On the opposite side of the article 16 of laundry, an air jet 41 blows on the article 16 of laundry to more likely position the article 16 between the jaws of the clamp 40. The air jet 41 rotates or moves into position. For example, the air jet 41 connects with the drive 34 or structure supporting the moveable clamp 30. The rotatable clamp 30 rotates the article 16 of laundry around the air jet 41, and the air jet 41 moves laterally with the rotatable clamp 30. Alternatively, the air jet 41 is spaced away from the path of travel of the article 16 of laundry, but directed to jet air or other gas at the article 16 of laundry.

Once the clamp 40 clamps the article of laundry, the clamp 38 and rotatable clamp 30 release the article 16 of laundry. After release, the clamp 40 moves laterally with the article 16 of laundry. The clamp 40 drags the article 16 of laundry over a rotatable support 42. The clamp 40 moves above the rotatable support 42, dragging a part of the article 16 of laundry over the rotatable support 42. Less than the entire article 16 of laundry is dragged past the rotatable support. For example, about ⅓-½ or other amount of the article length is dragged over the rotatable support 42. Keeping the distance low for larger articles may allow articles of different sizes to be spread by the same apparatus. In alternative embodiments, the rotatable support 42 moves to drag the article 16 of laundry while the clamp 40 is stationary or also moving.

The rotatable support 42 is a wheel, roller, belt, or other device. In the embodiment shown, the rotatable support 42 includes a belt with two pulleys or wheels. In other embodiments, a single wheel or three or more wheels with or without a belt may be used.

The rotatable support 42 is positioned to provide rotation around an axis extending along the direction of relative movement of the clamp 40 and the rotatable support 42. The rotatable support 42 is shown as being a generally vertical belt, but angled (see FIG. 2) to ease dragging (i.e., more vertical than horizontal). Other angles may be provided. The angle tensions the article 16 between the clamp 40 and the rotatable support 42 to avoid loss of traction and undesired sagging (too much vertical) and jamming (too much horizontal).

Figure 5:
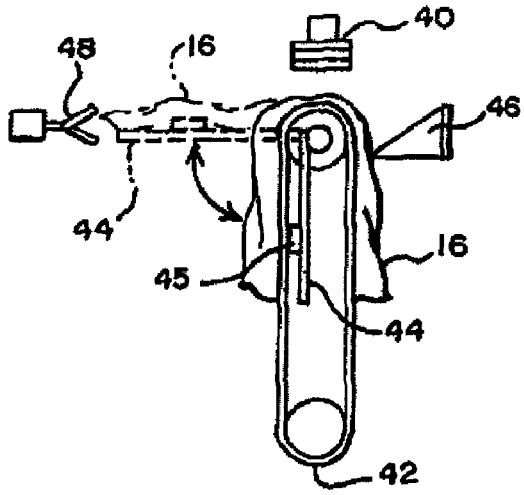
FIG. 5 is a back view of another one of the middle stages of FIG. 2.

The rotation of the rotatable support 42 causes the article of laundry to have more or less material hanging on a given side of the rotatable support 42. As shown in FIGS. 2 and 5, the article 16 of laundry drapes over the rotatable support 42 while held by the clamp 40. After dragging, the article 16 of laundry includes a portion near or at a short edge held above and to one side of the rotatable support 42. The rotatable support 42 is at a middle or other region lengthwise, with a portion of the article hanging to each side and the remainder of the length hanging off that has not been dragged over the rotatable support 42. Different amounts or a same amount of the width of the article 16 of laundry hang from each side. Depending on the draping and where the clamp 40 clamps the article 16, the edges hanging from the sides of the rotatable support 42 may or may not be horizontal.

One or more sensors 45 detect an extent of the article 16 of laundry hanging from one or both sides of the rotatable support 42. For example, a sensor 45 detects whether the article 16 of laundry hangs in front of the sensor about 6-24 inches down from the rotatable support 42. The sensor 45 senses an edge of the article 16 of laundry. If blocked, the edge is below the sensor 45. If not blocked, the edge is above the sensor 45.

A drive rotates the rotatable support 42. For example, an electric motor rotates a pulley, which rotates the belt. The direction of rotation depends on input from the sensor 45. Alternatively, the direction of rotation is fixed. The rotatable support 42 is rotated to bring the edge up or down to the sensor 45. Once the edge is detected, such as being no longer blocked or now being blocked, the rotation is stopped. The rotation may occur after dragging and/or during dragging. For example, the rotation occurs during dragging to prevent the article 16 of laundry from falling off the rotatable support 42 and occurs after dragging to align the article for further processing.

The rotation alters the lengths of the article of laundry hanging from each side of the rotatable support 42. The hanging of the article 16 of laundry is rotatably adjusted such that an edge of the article 16 of laundry hanging from the rotatable support 42 is reoriented. For example, the edge may be shifted to be more horizontal. The rotation adjustment more likely results in a length of the article 16 on one side within a desired range.

In an alternative embodiment, two rotatable supports 42 face each other on opposite sides of the movable platform 44. The two rotatable supports 42 create a v shape, but other relative orientations may be used. The clamp 40 may release the article 16 for rotation by both rotatable supports 42. The wanted edge can be rolled evenly to within inches of the tops of each rotatable support 42 from either side, on clamps 48 side or the opposite side of rotatable supports 42. The clamps 48 can retrieve the wanted edge at the top location.

A plate 46, brush, or other structure may rotate towards and away from the moveable plate 44. The plate 46 helps remove any improperly placed articles of laundry 16 to clear the moveable plate 44 and the rotatable support 42 for subsequent articles of laundry 16. The plate 46 moves to the position shown in FIG. 5 while the article 16 of laundry is dragged over the rotatable support 42. Once the article 16 of laundry is being removed from the moveable plate 44, the plate 46 rotates one end away from the moveable plate 44.

The moveable platform 44 is a plate, prongs, bars, and/or other structures. In one embodiment, the moveable platform includes two slots for clamping, such as providing three plates or two prongs and a center plate. The slot or slots extend into a portion of the plate 44 or along an entire length of the plate 44 (e.g., forming two or more separate plates separated by the slot(s)). The slots allow the clamps 48 move through, adjacent to, or into the slots to clamp the edge of the article 16 of laundry laying across the slots. The moveable plate 44 is metal, wood, plastic, fiberglass or other material. The movable plate 44 is sized to hold the edge spaced away from a center of the article 16. The moveable plate 44 is square, rectangular, oblong, circular or other shape.

Pneumatic, chain, gear, air or other drive mechanisms may be provided to move the moveable plate 44. For example, a hydraulic or electric actuator acts as a release. The actuator allows gravity to move the moveable plate 44 downwards. Alternatively, the actuator powers or drives the moveable plate 44 downwards. The actuator 44 is also operable to move the plate back to the substantially horizontal position.

The movable platform 44 is positioned adjacent the rotatable support 42, such as extending generally along the axis of rotation of the rotatable support 42 or the direction of dragging. The moveable platform 44 is between the rotatable support 42 and the clamp 40. As the clamp 40 drags the article of laundry 42 over the rotatable support 42, the article 16 of laundry is on or suspended over the moveable platform 44.

The moveable plate 44 begins in a downward position, such as the vertical position shown in solid lines of FIGS. 2 and 5. In response to the edge detection by the sensor 45, the moveable plate 44 is rotated against the article 16 of laundry. After the edge is adjusted by the rotatable support 42 and before clamping by a clamp 48, the edge is lifted. Part of the article 16 is lifted to a substantially horizontal position as shown in dashed lines in FIG. 5. The movable plate 44 raises an edge of the article 16 of laundry hanging from one side of the rotatable support 42.

A minor or major portion of the article 16 of laundry rests on the moveable plate 44, including part of an edge. The edge is generally parallel with the axis of rotation of the moveable plate, but may be at a substantial angle. By lifting part of the article 16 of laundry from a vertical position hanging down from the rotatable support 42 and the clamp 40 to a horizontal position, the moveable plate 44 positions the article 16 of laundry for clamping by the clamps 48.

Figure 6:
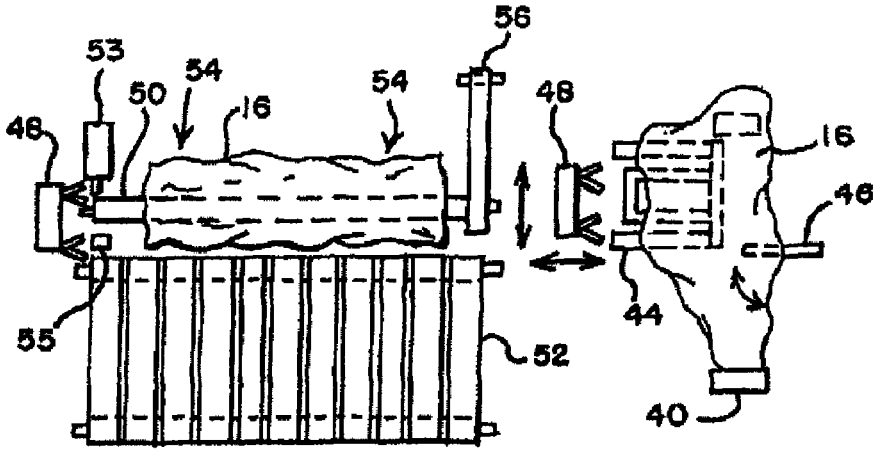
FIG. 6 is a top view of the middle stage of FIG. 5 and a final stage.

Referring to FIGS. 5 and 6, the clamps 48 are two clamps operating together and connected together. In one embodiment, the clamps 48 are metal cylinders extending from separate drives against plates. The clamps 48 are spaced apart by a same distance as slots in the moveable plate 44, such as 4-20 inches. The clamps 48 are sized and spaced to clamp different locations on the edge of the article 16 of laundry. The clamps 48 may or may not spread apart to tension the article 16 between the clamps 48 after clamping. While two clamps 48 are shown, 1, 3, or other numbers of clamps may be used.

Both clamps 48 move laterally from the moveable plate 44 over a roller 50 and are shown in two locations in FIG. 6. One or multiple groups of clamps 48 may be used. The clamps 48 are positioned against the article 16 of laundry as the article 16 of laundry rests on the moveable plate 44. The clamps 48 are movable in a horizontal position towards and away from the article 16 of laundry and the moveable plate 44. An electric eye or other detector may be used for determining when the clamps 48 are positioned against the article 16 of laundry. For example, the clamps 48 move towards the back of the moveable plate 44 until the article 16 of laundry is detected by sensors at both clamps 48. Alternatively, the clamps 48 are positioned at a given location under the assumption that the article 16 of laundry is positioned at that location. The clamps 48 grab an edge of the article 16 of laundry. The edge is clamped in a middle portion of a long side, but may be clamped in other portions of the edge.

After the clamps 48 grab the edge of the article 16 of laundry, the clamps 48 are moved laterally to drag the article 16 of laundry over the roller 50. The rotatable support 42 may rotate in the direction of movement to assist in dragging the article 16 off the rotatable support 42. During the dragging, a smoothing beam 56 rests by gravity or is driven against the top of the article 16 of laundry. The smoothing beam 56 presses the article 16 of laundry against the roller 50. In one embodiment, the smoothing beam 56 is plastic or fiber, but may be other materials. The smoothing beam 56 rotates to allow passing of the clamps 48 and positioning of the smoothing beam 56 on top of the article 16 of laundry while being dragged. The smoothing beam 56 is positioned to contact adjacent the end of the roller 50 closest to the moveable plate 44.

The roller 50 is sufficiently long to be longer than the longest short edge of the type of articles of laundry to be processed, but a shorter roller may be used. The roller 50 is not driven or braked, but may be a clutch roller or driven roller in alternative embodiments. The ends of the roller 50 are supported by beams or other structure. The beams or structure include bearings, pins, or other devices allowing the roller to be rotated against and away from the conveyor 52. In an alternative embodiment, the roller 50 is a conveyor, such as the transfer apparatus 67 described in U.S. Pat. No. 5,515,627, the disclosure of which is incorporated herein by reference. The clamps 48 deposit an edge into the transfer apparatus. The conveyor 52 is not provided.

A drive 53 connects with the beams supporting the roller 50. The drive 53 is operable to position the roller 50 against and spaced away from the conveyor 52. For depositing the article 16 of laundry from the clamps 48, the roller 50 is spaced away from the conveyor 52. The clamps 48 hold the article 16 of laundry on each side, but above, the roller 50. A sensor detects a leading or trailing edge of the article 16 of laundry and/or a position of the clamps 48 to cause release of the article 16 of laundry by the clamps 48 onto the roller 50.

Once deposited, the drive 53 positions the roller 50 adjacent the conveyor 52. The roller 50 and one end of the conveyor 52 are at a same height, but may be at different heights, such as the conveyor 52 being slightly lower than the roller 50 when positioned against each other. The roller 50 and the conveyor 52 have a same or similar lateral extent but one may be wider than the other.

The conveyor 52 includes one or more belts or straps tensioned over two or more rollers or pulleys. The conveyor 52 includes a platform beneath the straps in between the rollers in one embodiment, but embodiments may be provided without a platform. The conveyor 52 is driven by a gear, belt or chain connected from a motor to one or both of the rollers or pulleys. One of the rollers of the conveyor 52 is at the end for supporting the belts against the article 16 of laundry while being pressed by the roller 50. The drive 53 uses sufficient force to allow transfer of rotation force from the conveyor 52 to the roller 50.

The conveyor 52 rotates the upper run towards the roller 50 and article 16 of laundry. Since the article 16 of laundry contacts the conveyor 52, the article 16 of laundry feeds downward through the nip formed by the roller 50 and the conveyor 52.

A sensor 55 is positioned to detect an edge of the article 16 of laundry at or in the nip. The sensor 55 detects the edge. In response, the conveyor 52 reverses direction, preventing the article 16 of laundry from being discarded. Air jets 54 and/or force from conveying cause the detected edge to lay on the conveyor 52 as the article 16 of laundry is conveyed upward. For example, one or more air jet 54 blow the edge onto the conveyor 52. The conveyor 52 continues conveying to provide the entire article 16 of laundry in a laid out and spread position for further processing.

The controller controls the drive 53 to position the roller 50 against the conveyor 52 with the article 16 of laundry in the nip between the roller 50 and the conveyor 52. The controller controls the conveyor 52 based on the input from the sensor 55 to convey the article 16 of laundry such that the edge is adjacent the nip formed by the roller 50 and the conveyor 52 and to convey the article 16 of laundry away from the roller 50 on the conveyor 52.

FIGS. 7-9 show another embodiment of a stage between the clamp 40 and the clamp 48. Instead of one rotatable support 42, two rotatable supports 42 connect with the frame. Each rotatable support 42 is of a same or different type of device, size, and/or shape. For example, each rotatable support 42 includes one or more pulleys with a looped belt. The loop of the belt is positioned more vertical than horizontal. As shown in the front view of FIG. 8, the loop of the belts of the rotatable supports 42 form a "V" shape or are closer together at a bottom than the top. Viewed from the top in FIG. 7, the axes of rotation of the loops are parallel. In alternative embodiments, the rotatable supports 42 or loops are parallel, vertical, or have other relative positioning.

The uppers surfaces of each loop is the exposed belt at a top position of the loop. These upper surfaces are spaced apart horizontally, but provide for rotation of the article of laundry in a same or substantially same direction.

One or more drives 72 cause rotation of the rotatable supports 42. A same drive 72 may operate both rotatable supports 42, such as using a clutch or transmission to selectively activate one or both of the rotatable supports 42. In an alternative embodiment, a separate drive 72 activates each rotatable support 42. The drive or drives 72 rotate the rotatable supports 42, such as causing the looped belt to rotate around one or more pulleys. The rotation moves an edge 74 of the article of laundry 16.

The clamp 40 drapes the article of laundry 16 over both rotatable supports 42. The clamp 40 moves relative to the rotatable supports 42 and drags the article of laundry 16, while suspended from the clamp 40, over the upper surfaces of the rotatable supports 42. If the article of laundry 16 has sufficient length to span between the rotatable supports 42, further spreading is provided. One or more sensors or a failure to further process (e.g., failure of clamp 48 to grab an edge) may be used to remove improperly draped or small articles. For example, the rotatable supports 42 rotate to clear any improperly draped articles of laundry 16. The distance between the upper surfaces of the rotatable supports 42 may be sized to provide for spreading a range of sizes. For example, the rotatable supports 42 are sufficiently close together to allow hand towel or larger articles to hang between the upper surfaces of the rotatable supports. The distance may be adjustable, such as with a motor or by reconfiguration.

Once the article of laundry 16 is positioned to hang over the rotatable supports 42, the clamp 40 releases the article of laundry 16. The release occurs prior to or during rotating for adjusting the position of the article of laundry 16.

Sensors 45 and the sensors on the clamp 48 may be combined, such as provided by the sensors 76. The sensors 76 are triggered by the edge 74 of the article. If the sensors 76 are blocked, both rotatable supports 42 rotate to lift the edge 74 to the upper surfaces. One or more sensors 76 and a respective rotatable support 42 operate independently of one or more other sensors and another rotatable support 42 to make the edge more horizontal. The drive or drives 72 rotate each rotatable support 42 until the respective sensor 76 is not blocked or detects the edge 74, and then rotation for the respective rotatable support 42 is ceased. Ceasing rotation of both rotatable supports 42 presents the edge, substantially horizontal, between the upper surfaces of the rotatable supports 42.

Further sensors 45 may be provided to cause the rotatable supports 42 to rotate to lower the edge 74, such as during the dragging by the clamp 40, making it more likely to drape the article over the rotatable supports 42.

A stationary plate 78 is between the rotatable supports 42. The stationary plate 78 is positioned adjacent the upper surfaces to support the edge 74 of the article of laundry. The stationary plate 78 is metal, plastic, wood, or other material. The stationary plate 78 may be a flat plate, an I-beam, a bracket, angle iron, or have any other shape. The stationary plate 78 may include notches for positioning of the clamps 48 past a front edge of the stationary plate 78. In alternative embodiments, the plate 78 is moveable or rotatable. In another embodiment, no plate 78 is provided.

The clamp 48 is a single, pair, or greater number of clamps. The spacing of the clamps 48 corresponds to the notches and/or placement between the rotatable supports 42. The clamps 48 clamp at different locations along the edge 74, such as at the edge 74 suspended within the notches and/or between the rotatable supports 42. After clamping the edge 74, the clamps 48 are moved to drag or pull the article of laundry 16 by the edge 74 off the rotatable supports 42. The rotatable supports 42 may rotate to assist the dragging or pulling. For example, the rotatable supports 42 rotate at a rate or faster of the article being pulled from the rotatable supports 42. Alternatively, the rotatable supports 42 rotate away from the direction of dragging or are not rotated to resist the dragging. The resistance may remove any folds or wrinkles.

One or more pinch arms 70 provide resistance and/or help hold the article of laundry 16 in place for grabbing the edge 74. The pinch arm 70 is plastic, metal, wood, or other material. In one embodiment, the pinch arm 70 is a bar, pad, or block connected to a drive. In other embodiments, the pinch arm 70 is a roller, belt, or other structure. The pinch arm 70 is positioned away from the rotatable supports 42 while the article 16 is dragged over the rotatable supports 42. This positioning allows the article 16 to fall between the rotatable supports 42 and the pinch arms 70. Once the edge 74 is positioned, once the clamps 48 clamp the edge 74, or while the edge 74 is raised, the pinch arms 70 are positioned against the rotatable supports 42. Gravity or a driven force pinches the article 16 of laundry between the rotatable supports 42 and the pinch arms 70. The pinch arms 70 assist in holding the article of laundry on the rotatable supports 42. As the article 16 of laundry is dragged from the rotatable supports 42, the rotatable supports 42 rotate quickly to assist in discharging the article in preparation for placement onto the roller 50. For flattening out, the rotatable supports 42 may operate more slowly. The rotatable supports 42 may be stationary to add resistance or to be driven by another belt. As the article is moved from the rotatable supports 42, the pinch arms 70 may act to flatten out or remove folds or wrinkles from the article 16. In alternative embodiments, the pinch arms 70 are positioned against the article 16 for moving the edge 74 to the clamping position. In other embodiments, the pinch arms 70 move away from the article before or while the article is being moved off the rotatable supports 42.

FIG. 10 shows one embodiment of a spreader 80 being used with a folder 82. The spreader 80 is one of the embodiments shown herein or a different spreader. The spreader 80 separates an article of laundry from a bundle 14 of articles and spreads the article of laundry out flat. For example, the article of laundry is clamped in the bundle 14 and the clamp is moved away from the bundle 14. After this separation, the article of laundry is draped over one or more rotatable supports 42. The article is removed by an edge and laid out flat on the conveyor 52.

A sensor on the spreader 80 determines a size of the article of laundry. A camera, light sensor, or other sensor may be used, such as a sensor for measuring a diagonal length. In one embodiment, the sensor is one of the sensors 45, 76 adjacent the rotatable supports. Prior to spreading the article of laundry out flat, the size is measured from the draped article of laundry hanging between the rotatable supports 42. The edge is moved to a substantially horizontal position adjacent the upper surfaces of the rotatable supports 42 by rotation of the rotatable supports 42. A sensor 45 (see FIG. 9) is provided at a predetermined distance from the edge or upper surfaces. If the sensor is blocked, the article has a width greater than the predetermined distance. If the sensor is not blocked, the article has a width less than the predetermined distance. A binary size may be determined, such as hand towel or bath towel. Alternatively, a plurality of sensors are provided for a greater number of measurements or range of sizes.

One or more sensors may be used to determine that an article is larger or smaller than desired. An article of laundry of a certain size may be routed differently or discarded. For example, the rotatable supports 42 may rotate to discard an article that is overly large for the folder. The spreader 80 avoids providing an article of laundry to the folder 82 where the size is larger than a threshold, smaller than a threshold, or both.

The size is communicated to the folder prior to the folder receiving the article of laundry. Wireless, wired, or bus communications may be provided. For example, a controller managing operation of the spreader 80 forwards size information to a controller managing operation of the folder 82. As another example, a controller managing both the spreader 80 and the folder 82 receives the size information from the sensor and controls the folder as a function of the size information.

The spreader 80 spreads the article of laundry out flat on the conveyor 52. The article of laundry laying on the conveyor 52 is conveyed to the folder. For example, the article is fed to the folder by transitioning from one conveyor 52 to another.

The folder 82 is the folder disclosed in U.S. Pat. No. 5,300,007, or a different folder. The folder 82 receives the article of laundry laid out flat from the spreader 80. The folder 82 is responsive to the size from the sensor. For example, one or more runners move laterally to define a folding location. For smaller towels, the runners move inward. For larger towels, the runners move outward. By receiving the size before the article, the folder 82 may more rapidly respond or otherwise be ready for folding the article, reducing delay.

As another example, the folder 82 provides different folds (e.g., cross folds) or a different number of folds for different sized articles. The folder 82 may begin preparation for adjustment or begin adjustment prior to receiving the article. In another example, different sized articles are output by the folder 82 to different locations. The adjustments for routing or output sorting may be performed based on the size information.

In another embodiment, the spreader is used without the folder. For example, the spreader is provided for preparing articles for washing. Some articles may be difficult to separate. For example, folded sheets may be deposited for washing. These folded articles may be difficult to spread after washing. The spreader fully or partially spreads the articles.

For example, the articles are deposited by the clamp 40, the rotatable supports 42, or the clamp 48 into a washer or a cart for delivery to a washer.

While the invention has been disclosed above by reference to various embodiments, it should be understood that many changes and modifications can be made without departing from the scope of the invention. For example, any number of additional stages may be provided. Different clamp, conveyor, sensor, actuator or drive structures may be used, including now known or later developed structures. As another example, clamps may release, components may rotate or move in opposite directions, or other actions may occur to remove a caught or misaligned article 16 of laundry. Blowers and/or sensors may be used to assist in control and/or transfer of the article between components.

It is therefore intended that the foregoing detailed description be understood as an illustration of the presently preferred embodiment of the invention, and not as a definition of the invention. It is only the following claims, including all equivalents that are intended to define the scope of this invention.

What is claimed is:

1. An apparatus for spreading an article of laundry, the apparatus comprising:

a frame;

first and second rotatable supports connected with the frame, the first and second rotatable supports having horizontally spaced apart first and second upper surfaces, respectively, and having generally a same axis of rotation, the first and second rotatable supports arranged to provide for an article of laundry to be on opposite sides of each of the first and second rotatable supports, the opposite sides being where rotation of the first and second rotatable supports is operable to change a length of the article of laundry on both opposite sides of both the first and second supports at a same time; and at least one drive operable to rotate the first rotatable support, the second rotatable support, or the first and second rotatable supports, the rotation moving an edge of the article of laundry resting on the first and second rotatable supports, the rotation moving the edge from spaced away from at least one of the first and second upper surfaces to adjacent both the first and second upper surfaces and then halting the rotation with the edge adjacent to and the article of laundry on the first and second upper surfaces.

2. The apparatus of claim 1 further comprising a first clamp connected with the frame, the first clamp and rotatable support operable to move relative to each other such that the article of laundry held by the first clamp drapes over the rotatable support, the first clamp operable to release the article of laundry for the rotation to move the edge.

3. The apparatus of claim 2 wherein the first clamp moves and drags the article of laundry while suspended from the first clamp over the first and second rotatable supports.

4. The apparatus of claim 1 further comprising:

a first sensor operable to sense the edge of the article of laundry while draped over the first and second rotatable supports;

wherein the first drive is responsive to the first sensor to rotate the first rotatable support until the edge is sensed by the first sensor.

5. The apparatus of claim 1 further comprising:

a first clamp operable to clamp the edge of the article of laundry hanging between the first and second rotatable supports after the rotation.

6. The apparatus of claim 5 further comprising a stationary plate with a pair of notches, the stationary plate being between the first and second upper surfaces, wherein the first clamp comprises a pair of clamps operable to clamp different locations on the edge adjacent the notches.

7. The apparatus of claim 1 wherein the first and second rotatable supports each comprise a pulley with a belt, the belt being in a loop positioned more vertical than horizontal, the first and second uppers surfaces each comprising the belt at a top position of the loop.

8. The apparatus of claim 7 wherein the first and second upper surfaces are farther apart than first and second bottom portions of the loops of the first and second rotatable supports, the axes of rotation of the loops being parallel in one dimension.

9. The apparatus of claim 1 further comprising a pinch arm operable to pinch the article of laundry between the pinch arm and the first rotatable support.

10. A method for spreading an article of laundry, the method comprising:

dragging a first part of the article of laundry over first and second rotatable supports, the first rotatable support spaced from the second rotatable support, the first rotatable support having first and second sides, the second rotatable support having first and second sides;

rotatably adjusting the article of laundry with the first and second rotatable supports, an edge of the article of laundry hanging from the first sides of the first and second rotatable supports while another portion of the article of laundry hanging from the second sides of the first and second rotatable supports, the rotatably adjusting of the article of laundry adjusting the edge of the article of laundry to hang generally horizontally between the first and second rotatable supports, the edge being other than horizontal when hanging before the rotatably adjusting and the rotatably adjusting causing the other portion to have a greater length hanging on the second sides; and clamping the edge of the article of laundry.

11. The method of claim 10 wherein dragging comprises dragging the article of laundry to hang between and over the first and second rotatable supports; and further comprising releasing the article of laundry prior to rotatable adjustment.

12. The method of claim 10 wherein rotatably adjusting comprises shifting the edge to be more horizontal and between upper surfaces of the first and second rotatable supports.

13. The method of claim 10 wherein clamping the edge comprises clamping the edge in notches of a stationary plate between the first and second rotatable supports.

14. The method of claim 10 further comprising:

after clamping the edge, pulling the article of laundry by the edge off of the first and second rotatable supports; and pressing the article of laundry against at least the first rotatable support while pulling by the edge.

15. A method for spreading an article of laundry, the method comprising:

separating the article of laundry from a bundle of articles;

determining, with a sensor, a size of the article;

spreading, with a spreader, the article of laundry out flat;

feeding the article of laundry to a folder; and adjusting the folder as a function of the size.

16. The method of claim 15 wherein separating comprises clamping the article of laundry in the bundle and moving the clamp away from the bundle, wherein spreading comprises laying the article of laundry on a conveyor, and wherein feeding comprises conveying the article of laundry.

17. The method of claim 15 wherein adjusting the folder comprises moving a runner operable to control a position of a fold.

18. The method of claim 15 wherein adjusting the folder comprises establishing an output sorting of the folder.

19. The method of claim 15 further comprising:

communicating the size to the folder prior to the folder receiving the article of laundry.

20. The method of claim 15 wherein determining comprises determining the size prior to spreading out flat.

21. The method of claim 20 wherein determining comprises:

draping the article of laundry; and determining whether the article of laundry is wider or not than a distance.

22. The method of claim 21 wherein draping comprises hanging the article of laundry between first and second rotatable supports and moving an edge to a substantially horizontal position adjacent first and second upper surfaces of the rotatable supports by rotation of the rotatable supports, and wherein determining comprises determining whether the article of laundry hanging downward from the edge extends past a sensor.

23. The method of claim 15 further comprising:

avoiding providing an article of laundry to the folder where the size is larger than a first threshold, smaller than a second threshold, or both.

24. An apparatus for spreading an article of laundry, the apparatus comprising:

a spreader operable to separate the article of laundry from a bundle of articles and spread the article of laundry out flat;

a sensor on the spreader operable to determine a size of the article of laundry; and a folder operable to receive the article of laundry laid out flat from the spreader, the folder responsive to the size from the sensor.

25. The apparatus of claim 24 wherein the folder comprises a runner operable to move and establish a fold line, the runner being positioned as a function of the size.

26. The apparatus of claim 24 wherein the spreader comprises first and second rotatable supports operable to position an edge of the article of laundry, the sensor adjacent the first and second rotatable supports.

27. An apparatus for spreading an article of laundry, the apparatus comprising:

a frame;

first and second rotatable supports connected with the frame, the first and second rotatable supports positioned such that an article of laundry is operable to drape over both the first and second rotatable supports at a same time with a first edge on a first side of the first and second rotatable supports and a second edge, opposite the first edge, on a second side of the first and second rotatable supports where rotation of one or both of the rotatable supports alters an orientation of the first edge while altering a length of the article hanging on the second side of the first and second rotatable supports;

at least one drive operable to rotate the first rotatable support, the second rotatable support, or the first and second rotatable supports.

* * * * *